United States Patent [19]

Davis

[11] 4,142,500

[45] Mar. 6, 1979

[54] TWO-STROKE ENGINE AND DIRECT THRUST PISTON

[76] Inventor: Allen V. C. Davis, 5600 Alta Canyada Rd., La Canada, Calif. 91011

[21] Appl. No.: 786,876

[22] Filed: Apr. 12, 1977

[51] Int. Cl.[2] ..... F02F 1/00

[52] U.S. Cl. ..... 123/193 P; 92/179; 123/65 V; 123/81 B

[58] Field of Search ..... 123/65 V, 81 R, 81 B, 123/193 P, 197 R, 197 A, 197 AB; 92/179

[56] References Cited

U.S. PATENT DOCUMENTS

| | | | |
|---|---|---|---|
| 320,839 | 6/1885 | Brotherhood | 92/179 |
| 373,072 | 11/1887 | Jarvis | 92/179 |
| 1,775,892 | 9/1930 | Salardi | 92/179 |
| 1,787,556 | 1/1931 | Smith | 92/179 |
| 2,023,466 | 12/1935 | Crowley | 123/197 R |
| 3,695,150 | 10/1972 | Salzmann | 123/193 P |

*Primary Examiner*—Charles J. Myhre
*Assistant Examiner*—David D. Reynolds
*Attorney, Agent, or Firm*—Perry E. Turner

[57] ABSTRACT

A cylinder with cross inlet and exhaust ports contains a combination piston and rod having on its piston end a piston head or face and slidably attached sealing sleeve, and its other end is rotatable via a rod bearing attached to a crankshaft. The rotational motion of the rod with the crankshaft imparts an undulating movement to the piston head during its stroke motion and, in unison with the slidably attached sealing sleeve, effects a sequence wherein the exhaust ports open ahead of the inlet and close before the inlet closes.

12 Claims, 6 Drawing Figures

TWO-STROKE ENGINE AND DIRECT THRUST PISTON

BACKGROUND OF THE INVENTION

1. Field of the Invention

This invention relates to loop scavenged two-stroke internal combustion engines.

2. Description of the Prior Art

In the simplest construction of the two-cycle engine heretofore known, porting has been of the loop scavenged type which has necessitated that whichever port was the first to open was also the last to close. Conventionally, the exhaust port opened approximately 20° before the inlet and thereby closed 20° after the inlet. This conditon prohibited the buildup in pressure of the fresh inlet charge in the cylinder and also allowed a portion of this charge to pass out the exhaust ports. The result has been a low scavenging efficiency and a considerable loss of potential specific performance.

In a one-piece piston such as heretofore known, sealing has been accomplished by rings which had the undesirable qualities of a line contact with the cylinder wall due to their angular change of engagement throughout their stroke cycle, resulting in shortened wear life. Also, the exposure of the outer sealing face of such a piston to the high pressure gas forces results in the seals being partially retracted to permit blow-by. Blow-by is reduced by highly spring loading the rings outwardly, and this in turn causes excessive friction.

SUMMARY OF THE INVENTION

This invention embraces a piston and rod combination member which utilizes the byproduct rotational motion of the crankshaft to impart an undulating motion to the piston head which, in combination with appropriately spaced ports in a cylinder wall, effects sequential exhaust and inlet porting in the simplest version of the two-cycle engine. Attached in sealing and sliding engagement with the piston head is a sleeve with which it moves in unison as they axially traverse the cylinder throughout their stroke cycle.

DESCRIPTION OF PREFERRED EMBODIMENT

Figure 1:
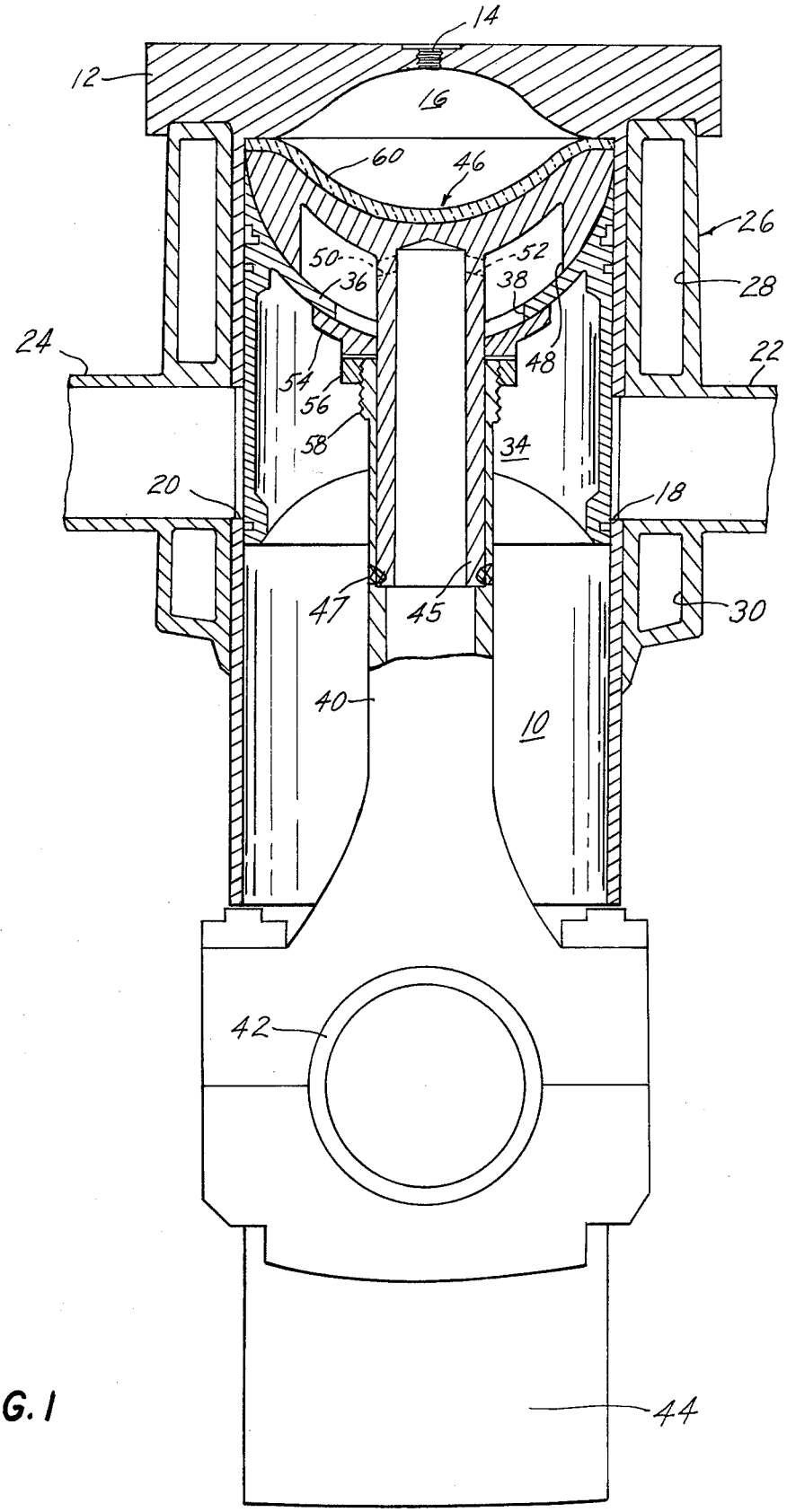
FIG. 1 is a longitudinal sectional view of a two-stroke engine in accordance with this invention, showing the parts and their relation at the top dead center position of the connecting rod.

Referring to FIG. 1, a housing 10 shown as a cylinder has a top wall 12 which is adapted as at 14 to support suitable means, such as a spark plug or fuel injector (not shown) for effecting combustion of a fuel-air mixture compressed in an immediately adjacent chamber 16 of desired shape and size. The cylinder 10 is provided with inlet and exhaust ports or openings 18, 20, a connection 22 to a suitable source of air or fuel-air mixture, and an exhaust connection 24. For a diesel engine, the connection 22 may be to a source of compressed air or uncompressed air. Additionally, a gasoline engine may be crankcase scavenged. Desirably, the cylinder 10 is provided with suitable cooling means, such as a cooler jacket 26 that incorporates the connections 22, 24 and has conduits or openings 28, 30 through which water or other cooling medium is circulated for removing heat from the cylinder wall.

Within the cylinder 10 is a sealing skirt or sleeve 34 which is adapted to slide longitudinally between an upper position in which it closes and seals off the ports from the interior of the cylinder, and a lower position in which it essentially clears the ports. At its upper end, the sealing sleeve has a concave spherical wall 36 in which there is a central opening 38 through which the upper end of a connecting rod 40 extends. The rod 40 is connected in conventional fashion to the crank rod bearing 42 that is offset from the axis of a crankshaft 44 so that rotation of the lower end of the rod effects rotation of the crankshaft.

The upper end of the rod 40 extends over and is welded to the stem 45 of a piston head or face member 46. The weld is shown at 47 to be made through the rod 40 directly to the stem 45, and preferably is a parent weld. The lateral face of the piston head 46 from which the stem 45 extends is a convex spherical surface that matingly and slidably bears against the confronting surface of the top wall 36 of the sealing sleeve 34. In the example shown, the convex spherical surfaces of the piston head 46 is substantially a hemisphere with a sizeable relief 48 formed therein to provide a head that is light in weight. The head 46 and stem 45 may be ground from a single piece of bar stock, or they may be formed separately and welded together. Desirably, ports 50, 52 extend through the upper portion of the stem between the relief 48 and the interior of the stem and rod so as to receive oil passed up through the rod of lubricating and cooling purposes. As will be appreciated, any conventional means may be employed for passing oil through connecting rods as employed in prior art engines.

Desired smoothness of sliding movement of the head 46 is facilitated by the provision of a dish element 54 placed on the rod 40 and adapted to slidable engage the lower surface of the top wall 36 of the sealing sleeve 34. The element 54 is large enough to overlap the opening 38 sufficiently so that the element 54 still engages the top wall 36 at the extreme angular positions assumed by the head 46 and the stem 45 and rod 40 that are integral therewith. The element 54 is adjusted to the desired engagement with the wall 36 by a nut 56 that is turned on a threaded portion 58 of the rod 40 and then suitably locked after the desired adjustment is achieved in assembly.

The upper face or surface of the head 46 may take any of a variety of forms and shapes. In the arrangement shown, such face is dished so as to be generally convex. It may, however, be made convex spherical, flat, domed, or irregular if desired. Preferably, however, the upper surface is formed of material that withstands the high temperatures generated upon ignition of the mixture above it. For example, the upper surface may comprise a coating 60 of ceramic material.

With the structure above described, the piston head 46 and the sealing sleeve slide longitudinally in unison, and the head additionally undulates, as the lower end of the rod 40 is rotated. The invention insures that combustion forces applied to the head 46 are caused to exert direct thrust along the rod 40. Thus, side thrusts due to wrist pin couplings of the prior art are eliminated along with such pins. In this regard, since gas forces are applied directly to the head 46, and such head is rigidly secured to the rod 40, all such forces are applied directly through the head along the centerline of the rod to the crank rod bearing.

The head 46 functions while undulating to effect desired sequential porting for the engine. For explanation, it will be assumed that the lower end of the rod 40 is at top dead center, as in FIG. 1. In this position, which is at the top of the compression stroke, the sealing sleeve closes off both inlet and exhaust ports, and seals the ports, and hence both inlet and exhaust gases, from the interior of the cylinder.

Figure 2:
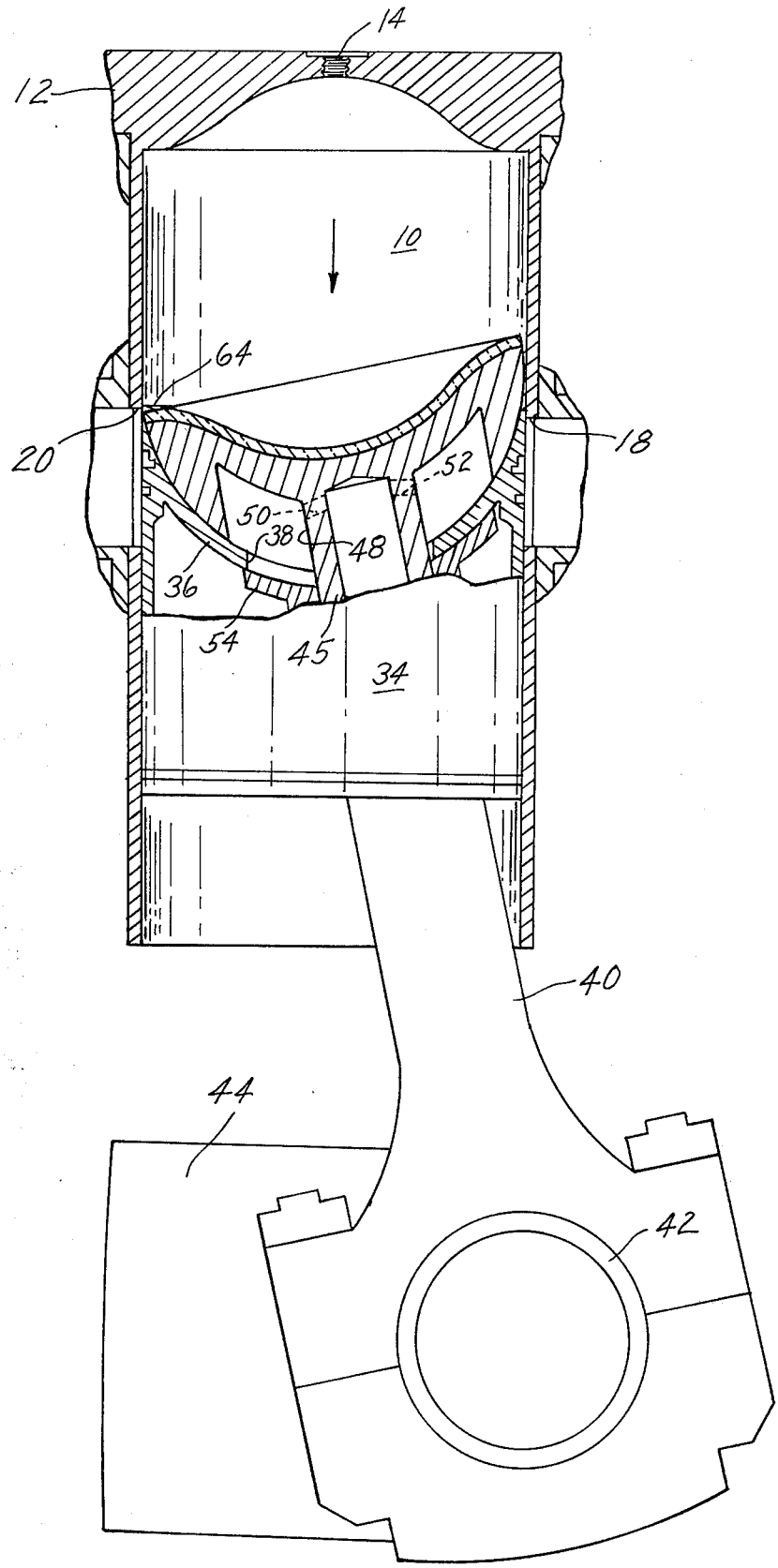
FIG. 2 is a fragmentary longitudinal sectional view like FIG. 1, showing the relations of the parts at the position of the connecting rod when it has been rotated 95° from top dead center, at which the exhaust port is about to be uncovered by either the outer edge of the piston head or the sleeve that is longitudinally slidable therewith in unison.

FIG. 2 shows the relations of the parts upon the rod 40 being forced to the exhaust opening position, viz., 95° after top dead center (ATDC). At this position, it will be observed that the head 46 has been correspondingly rotated or undulated, and the lower point of its periphery is passing below the upper portion of the exhaust port 20. At this position, the upper end of the sealing sleeve 34 is above the lowermost portion of the head 46, as indicated at 64, and the sleeve 34 still seals off the ports from each other and the interior of the cylinder 10. Immediately after reaching this position, the upper end of the sleeve 34 clears the upper portion of the exhaust port 20 and thereafter progressively clears the ports 20, 18.

Figure 3:
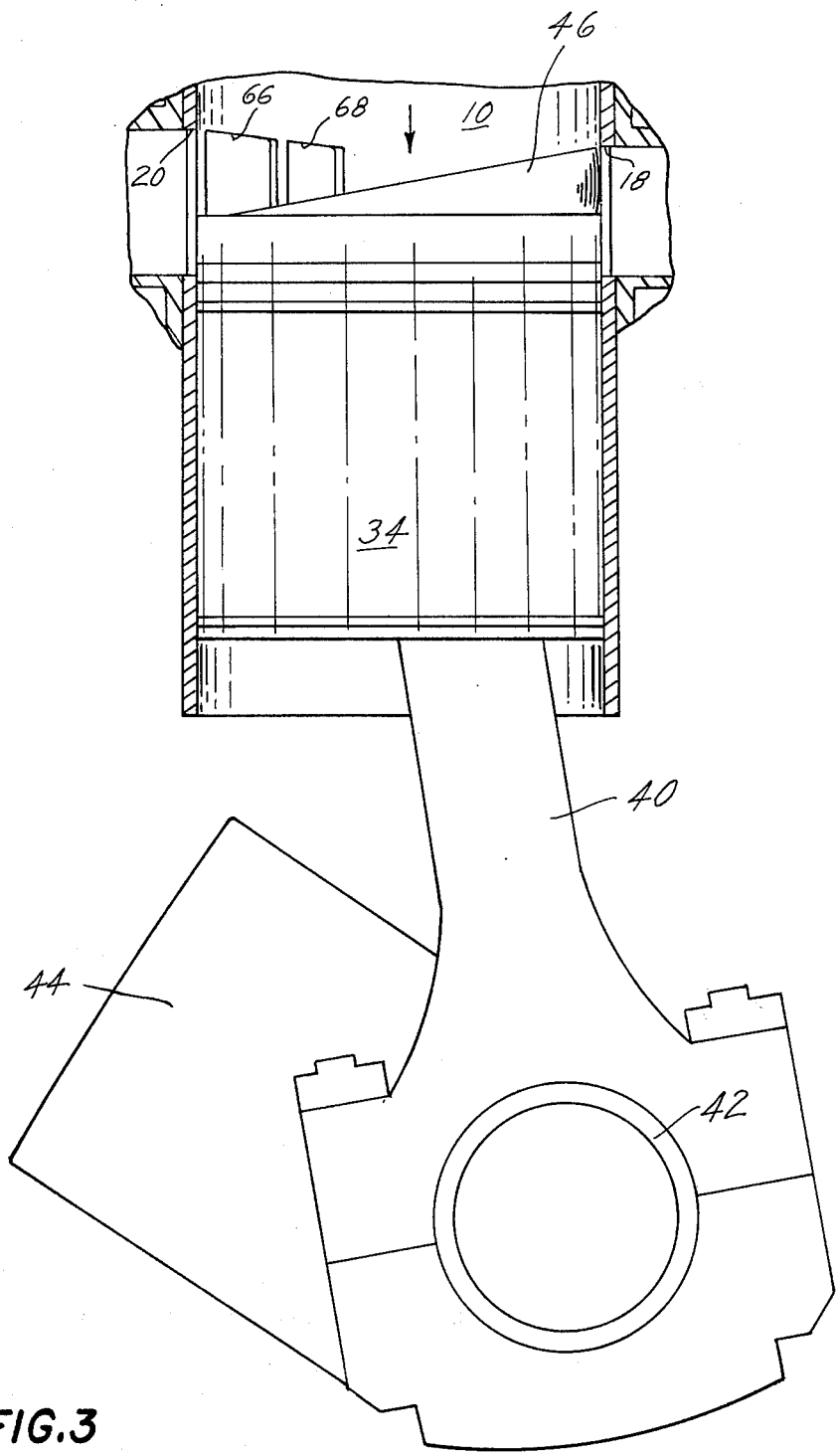
FIG. 3 is a fragmentary sectional and cutaway view showing the relations of the parts when the lower end of the connecting rod has reached 120° after top dead center, showing the exhaust ports substantially uncovered, and the inlet about to be uncovered.

However, the head 46 prevents the inlet port from being exposed until the exhaust has been exposed long enough to permit higher pressure and high temperature gases to pass through the exhaust in sufficient amount that the pressure is reduced enough to allow subsequently introduced inlet air to optimally scavenge. FIG. 3 shows the relations of the parts upon the rod 40 being forced to the inlet opening position, i.e., 120° ATDC. At this position, the exhaust openings 20, 66, 68 will be seen to be approximately one half uncovered by both the sealing sleeve and the piston head 46. However, the lateral surface of the head 46 still covers the inlet port 18.

In this regard, the lateral surface of the head 46 does not tightly seal the inlet from the interior of the cylinder 10. Rather, through the sphere-to-cylinder geometry it substantially covers the portions of the inlet openings which it confronts. Fresh mixture is able to enter the cylinder past the top of the head at this point, as it moves clear of the inlet, and at sufficient pressure to aid the scavenging of the exhaust gases.

Figure 4:
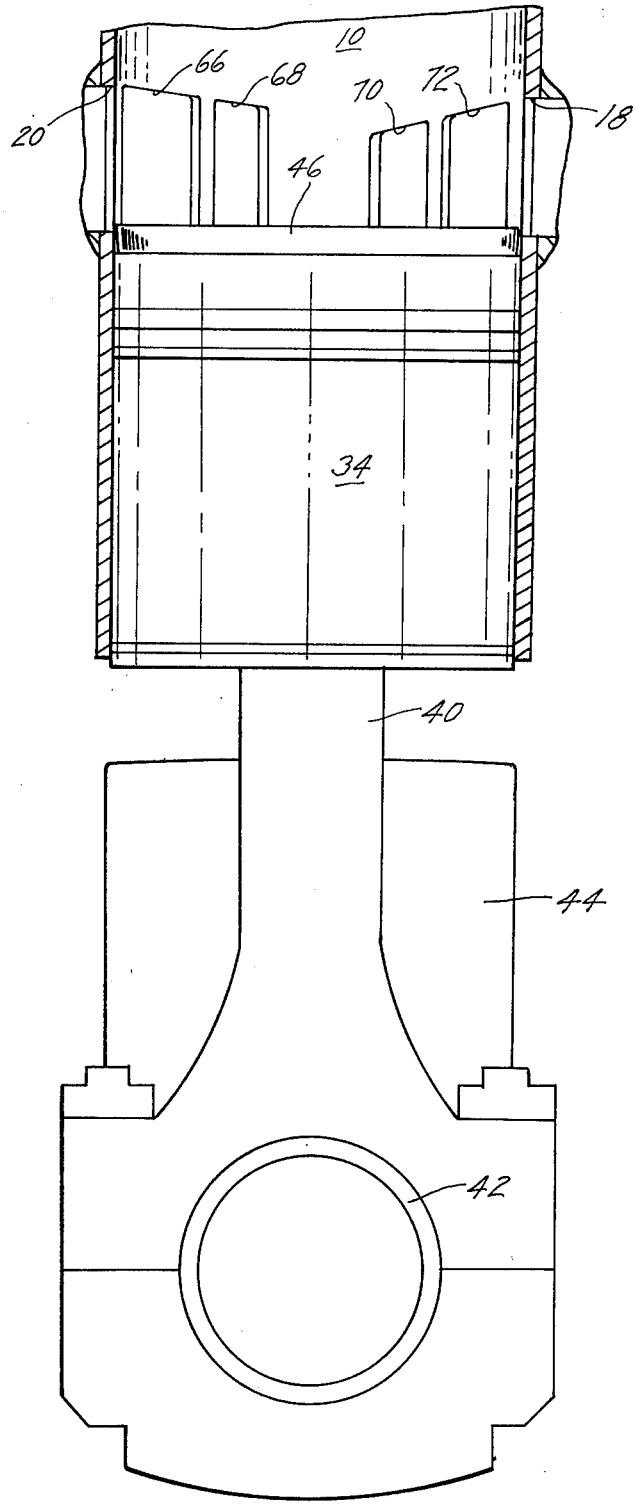
FIG. 4 is a similar fragmentary sectional and cutaway view showing the relations of the parts when the lower end of the rod has been rotated 180° from top dead center, showing both inlet and exhaust ports uncovered and the piston about to undergo its compression stroke.

From the position shown in FIG. 3, the inlet is progressively uncovered by the head 46 while the exhaust continues to be progressively uncovered by the head 46 and sleeve 34 until the lower end of the rod 40 reaches 180° ATDC as shown in FIG. 4. During the movement to this position, fresh mixture continues entering the cylinder and siding the desired scavenging. At 180° ATDC, of course, all exhaust openings 20, 66, 68 and inlet openings 18, 70, 72 are exposed.

Figure 5:
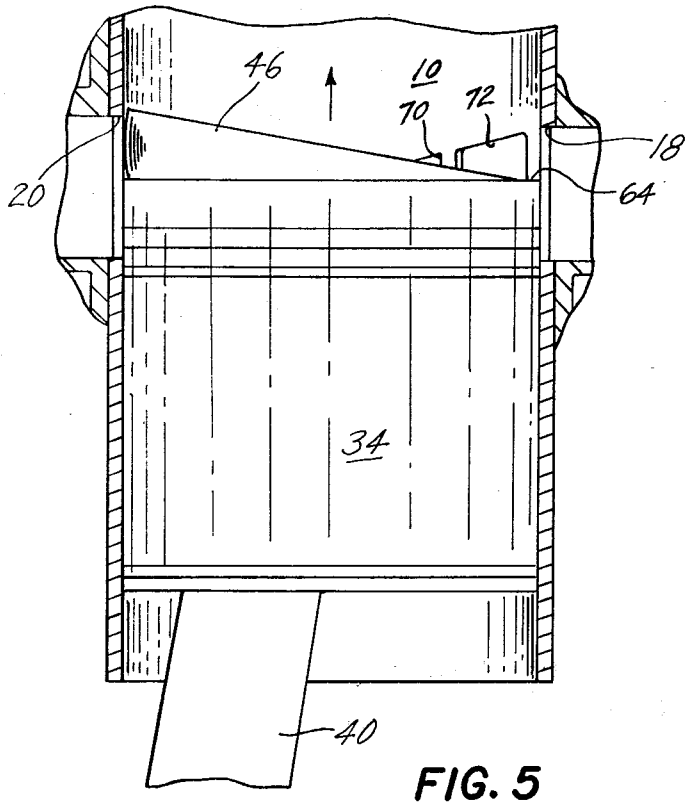
FIG. 5 is a fragmentary sectional and cutaway view showing the relations of the parts when the lower end of the rod has reached 245° after top dead center, at which the exhaust ports are closed by the confronting spherical surface of the piston head and cylindrical surface of the sleeve that is longitudinally slidable in unison with the head.

Scavenging continues as the rod 40 rotates past its lowermost position shown in FIG. 4 and causes the head 46 to rise towards the top of the cylinder 10 in the compression stroke. In this regard, the relations of the parts are shown in FIG. 5 when the rod 40 has reached the exhaust closing position at 245° ATDC. Between the positions shown in FIGS. 4 and 5, the head 46 and sealing sleeve 34 progressively cover the exhaust, permitting a buildup of cylinder pressure higher than the exhaust pressure. The peak of such buildup is reached between the positions shown in FIGS. 5 and 6, at which latter position further increase is terminated.

Figure 6:
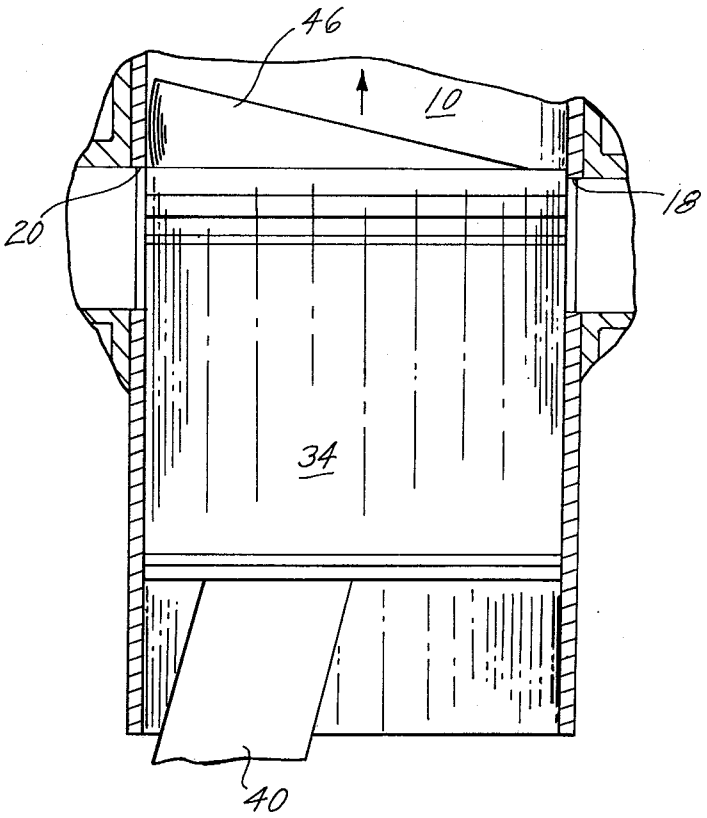
FIG. 6 is a fragmentary sectional and cutaway view showing both inlet and exhaust ports closed by the confronting cylindrical surface of the sealing sleeve at the position of the parts after the rod has reached 265° from top dead center.

FIG. 6 shows the relations of the parts when the rod 40 has rotated to the position 265° ATDC when both inlet and exhaust are closed, and the head 46 and sleeve 34 continue rising during the compression stroke, following which expansion and compression strokes are repeated with the above described actions.

The sealing sleeve 34 of the piston of this invention may carry various arrangements of suitable sealing and oil scraper rings against the cylinder 10 and head 46, and may be free to rotate to insure long life. It is a close fitting thin-walled member that does not have to be cam ground, but may expand under operation until the heat rejected to the cylinder wall matches its heat input. In some types of applications, this close sealing fit may allow deletion of piston rings to provide greater simplification of structure.

A further point to be noted is that the undulations of the head 46 are essentially rocking movements about portions thereof that are at right angles to the rotational movement of the outer end of the rod 40, i.e., the head moves as though pivoted on the sleeve on a line at right angles to the direction of rotation of the rod. Such pivot portions in one arrangement are shaped substantially cylindrical within the angle that accommodates the undulations, and may be in bearing relation to the cylinder wall.

The periphery of the head 46 in the illustrations is in the same plane as the center of the hemisphere. However, such peripheral edge may be lower than the center, so long as it is at the level for opening and closing the exhaust and inlet in the manner above described. Also, the head and sleeve combination piston of this invention permits various heights for the inlet and exhaust openings to be utilized. All exhaust and inlet openings may be of graduated heights so that the periphery of the head at a given angle most completely covers or uncovers the different port openings.

This invention embraces any structural shapes for or modifications of the foregoing so long as they retain the essential features of the piston of this invention, viz., a unitary head and rod part, and a sealing sleeve part for sealingly engaging the wall of a housing and the head, with both head and sleeve movable longitudinally in the housing simultaneously, and with the head undergoing undulating or rocking movement during such longitudinal movement, as the outer end of the rod rotates, wherein the adjacent portions of the head and sleeve are cooperative to effect sequential porting of exhaust and inlet.

I claim:

1. In combination:

a housing having cross ports for inlet and exhaust; and a piston including:

sealing sleeve means having face-to-face sealing and sliding engagement with the housing;

a connecting rod extending into said housing and through said sleeve means;

and a head secured to the inner end of said rod, said head undergoing undulating movement as the other end of the rod rotates, means intercoupling said head and said sleeve means for simultaneously longitudinally slidable movement in unison during rotation of said other end of said rod, said head undulating during sliding movement with said sleeve means so as to extend past the end of said sleeve means, the lateral surface of the portion of said head that extends past the end of said sleeve means being substantially the same dimension as the outer diameter of said sleeve means, the portions of the head extending past the end of said sleeve means being operative in one direction of sliding movement to confront the exhaust ports and in the other direction of sliding movement to confront the inlet ports, whereby said head during its undulating movement cooperates with said sleeve means and said ports to effect sequential porting of said ports.

2. The combination of claim 1, wherein the portions of the lateral surface of the head that effects the sequential porting is spherical.

3. The combination of claim 2, wherein the said sleeve means spherically interfaces with the portion of the lateral surface of said head adjacent the periphery of said sleeve means.

4. The combination of claim 1, wherein said head is not in sealing relations with the housing.

5. The combination of claim 3, wherein said housing is a cylinder, and wherein said sleeve means comprises a cylindrical element having a spherical wall surface at the end that interfaces said head.

6. In combination:

a housing having cross ports for inlet and exhaust; and a piston including:

sealing sleeve means having face-to-face sealing and sliding engagement with the housing;

a connecting rod extending into said housing and through said sleeve means;

and a head secured to the inner end of said rod, wherein said sleeve means spherically interfaces with the portion of the lateral surface of said head adjacent the end of said sleeve means, wherein said housing is a cylinder and said sleeve means comprises a cylindrical element having a spherical wall surface at the end that interfaces said head, an adjustably positionable element adjusted to slidably engage the inner surface of said sleeve wall, said wall surface having an opening through which said rod extends, said adjustably positionable element spanning said opening;

and means securing said adjustably positionable element in its position of sliding engagement with said sleeve wall, said head undergoing undulating movement as the other end of the rod rotates, said head and said sleeve means being simultaneously longitudinally slidable in unison during rotation of said other end of said rod, and said head during its undulating movement cooperating with said sleeve means and said ports to effect sequential porting of said ports, and wherein the portion of the lateral surface of the head that effects the sequential porting is spherical.

7. The combination of claim 2, wherein the lower end of said rod rotates away from the exhaust port during the first 180° of travel from top dead center, and towards the exhaust during the remaining 180° of rotation back to top dead center.

8. The combination of claim 1, wherein the sealing sleeve means spherically interfaces with only the outer edge portion of the lateral surface of said head that cooperates with said sleeve means to effect the sequential porting.

9. The combination of claim 5, wherein the portions of the lateral surface of said head not interfacing with said sleeve means have cylindrical contours in bearing relation with the cylinder wall.

10. A piston comprising:

a sleeve;

a head positioned at one end of said sleeve;

and a rod extending through said sleeve and rigidly secured at one end to said head;

and means intercoupling said unitary rod and head with said sleeve so that rotation of the other end of said rod effects simultaneous movement of the sleeve and head along the axis of said sleeve, together with undulating movement of said head, said head extending past the end of said sleeve during its undulating movement, and the portion of said head that extends past the end of said sleeve during such undulating movement being substantially the same dimension as the outer diameter of said sleeve.

11. A piston in accordance with claim 10, wherein the confronting portions of said head and sleeve are spherically interfacing surfaces.

12. A piston in accordance with claim 10, wherein said sleeve is a cylindrical element, and wherein the lateral surface of said head that moves past the end of said element is a convex spherical surface.

* * * * *